US005371924A

United States Patent [19]

Schmale

[11] Patent Number: 5,371,924

[45] Date of Patent: Dec. 13, 1994

[54] HINGES FOR PICTURE FRAMES

[75] Inventor: Karl E. Schmale, Lüdenscheid, Germany

[73] Assignee: Schmale GmbH & Co. KG., Lüdenscheid, Germany

[21] Appl. No.: 3,247

[22] Filed: Jan. 11, 1993

Related U.S. Application Data

[63] Continuation of Ser. No. 768,664, Oct. 3, 1991.

[30] Foreign Application Priority Data

Feb. 3, 1990 [DE] Germany ..... 9001206[U]
Nov. 26, 1990 [DE] Germany ..... 9016050[U]

[51] Int. Cl.[5] ..... E05D 11/06
[52] U.S. Cl. ..... 16/346; 16/347; 16/225; 16/384; 248/472; 40/152.1
[58] Field of Search ..... 16/252, 346, 347, 365, 16/382, 235, 225, 384, 268; 248/469, 472; 182/165; 40/152.1

[56] References Cited

U.S. PATENT DOCUMENTS

| | | | |
|---|---|---|---|
| 295,817 | 3/1884 | Sangster | 16/346 |
| 318,123 | 5/1885 | Laurence | 16/346 |
| 485,589 | 11/1892 | Ravenel, Jr. et al. | 16/346 |
| 992,115 | 5/1911 | Danner | 16/346 |
| 1,769,553 | 7/1930 | Tangenberg | 16/346 |
| 2,197,286 | 4/1940 | Zieman | 16/347 |
| 2,372,303 | 3/1945 | Thiele | 16/347 |
| 2,577,399 | 12/1951 | Bell | 16/346 |
| 2,602,956 | 7/1952 | Reynolds | 16/268 |
| 2,811,741 | 11/1957 | Miller et al. | 16/376 |
| 3,056,377 | 10/1962 | Nelson | 248/472 |
| 4,236,274 | 12/1980 | Omote et al. | 16/225 |
| 4,878,266 | 11/1989 | Cubides | 16/225 |
| 5,291,635 | 3/1994 | Schmale | 16/371 |

FOREIGN PATENT DOCUMENTS

| | | | |
|---|---|---|---|
| 329588 | 8/1903 | France . | |
| 3017075 | 11/1981 | Germany . | |
| 8715323 | 2/1988 | Germany . | |
| 8809422 | 11/1988 | Germany | 16/252 |
| 15283 | of 1915 | United Kingdom . | |
| 344319 | 3/1931 | United Kingdom | 16/347 |
| 1168660 | 10/1969 | United Kingdom . | |
| 1182056 | 2/1970 | United Kingdom | 16/336 |
| 2026313 | 2/1980 | United Kingdom . | |

OTHER PUBLICATIONS

U.K. Patent Application No. GB 2,094,879A, pub. Sep. 1982, Inventor: A. F. Pearson.

*Primary Examiner*—Lowell A. Larson
*Assistant Examiner*—Donald M. Gurley
*Attorney, Agent, or Firm*—Spencer, Frank & Schneider

[57] ABSTRACT

A hinge for use with a picture frame and a set-up base, includes first and second hinge leaves, each hinge leaf having claws, the claws of the first hinge leaf for fastening the first hinge leaf to a picture frame and the claws of the second hinge leaf for fastening the second hinge leaf to a set-up base. A hinge joint is disposed at first ends of the hinge leaves, configured of knuckles through which a hinge wire passes for connecting the first and second hinge leaves to one another. A connecting web is movably articulated to the first hinge leaf at an end edge of the first hinge leaf opposite the hinge joint. When the hinge is in an opened position, the connecting web is arranged at an angle to the first hinge leaf and is supported on the second hinge leaf. When the hinge is in a closed position, the connecting web is pivoted into a position essentially parallel to the first hinge leaf. The hinge ensures a stable limitation of an opening angle of the hinge leaves with respect to one another and thereby ensures a stable limitation of an opening angle of the supporting base with respect to a picture frame.

13 Claims, 5 Drawing Sheets

HINGES FOR PICTURE FRAMES

This application is a continuation of application Ser. No. 07/768,664 filed Oct. 3, 1991.

BACKGROUND OF THE INVENTION

1. Field of the Invention

The invention relates to a hinge for picture frames including a set-up base, with the hinge having two hinge leaves that are connected to one another at the abutting edges by means of a hinge joint, which is configured as knuckles through which a hinge wire passes, and each leaf is provided with claws for one leaf to be fastened to the cover on the rear of the picture and the other to the set-up base.

2. Background Information

Hinges of the above mentioned type are known (U.S. Pat. No. 2,811,741; DE-U-8,809,422). For these prior art hinges the limit of the angle required for setting up the picture frame with the help of the supporting base is determined by stops, which are either configured as axial projections on the knuckles of the one hinge leaf and as matching axial recesses in the knuckles of the other hinge leaf, or they are provided along the knuckles of one hinge leaf, extending over the entire length of the knuckle that stops the other hinge leaf when the picture frame is set up. With prior art hinges the danger exists that under greater stress, which could easily result from improperly setting up the picture frame, the hinges could become damaged in the region of the stops and/or could become deformed.

SUMMARY ON THE INVENTION

The invention attempts to correct this situation. It is the object of the invention to configure a hinge of the type mentioned above in such as way that, while eliminating stops, it ensures a stable limitation of the opening angle of the hinge leaves with respect to one another and, consequently, also of the supporting base in relation to the picture frame. According to the invention, this objective is obtained in that a connecting web is articulated to one of the hinge leaves at the opposite edge of the hinge. If the hinge is opened, this connecting web is arranged at an angle to one hinge leaf and is supported on the other hinge leaf and, if the hinge is closed, the connecting web is pivoted into a position essentially parallel to the one hinge leaf.

The invention dispenses with stops, particularly in the region of the hinge joint. The opening angle of the hinge is instead determined by the length of the connecting web and the angle it forms with the first hinge leaf. The opening angle can thus be selected within limits. The opening angle of the hinge and, consequently, that of the set-up base in relation of the picture frame does not change, even if the set-up base should be pushed away from the picture frame beyond the set-up angle. The connecting web is supported by the other hinge leaf. The opening angle is fixed in this manner; snapping away of the set-up base is avoided. If the hinge is closed, the connecting web lies between the two hinge leaves - essentially parallel to the first hinge leaf - in order to limit the thickness of the hinge and thus to ensure a flat placement with close contact to the picture frame.

The materials used for the hinges according to the invention are thin, ensuring a non-bulky construction and concealed attachment. This does not result is any loss of stability.

In a further modification of the invention, the hinges are minimized and, in particular, they are configured in such a way that a further reduction of the hinge-leaf thickness results if one of the hinge leaves is configured from two superimposed leaf members, one of which is connected with the other hinge leaf by way of the hinge joint and is provided with claws, and the other is connected to the connecting web by means of one of the base joints and is provided with openings for the passage of the claws.

Forming one of the hinge leaves from two leaf members makes possible the reduction of the material thickness for the entire hinge without it having to sacrifice any stability. The two leaf members lie flat upon one another; they mutually support each other over their entire region. This facilitates attachment of the hinges to the cover of the picture and to the set-up base. Knobs and the like for stabilization are dispensed with.

In the invention, the openings angle of the hinge is defined by the length of the connecting web and the angle it forms with the first hinge leaf. The opening angle can initially be selected within limits; one feature of the invention provides two defined opening angles within the selected limits. If the hinge is closed, the connecting web lies between the two hinge leaves - essentially parallel to the first hinge leaf - in order to keep the hinge thickness within limits and thus to ensure flat placement with close contact to the picture frame.

The features and further modifications of the invention are defined in the dependent claims.

BRIEF DESCRIPTION OF THE DRAWING:

Embodiments of the invention are shown in the drawing and are described in detail below.

It is shown in.

DETAILED DESCRIPTION OF THE PREFERRED EMBODIMENTS

Figure 1B:
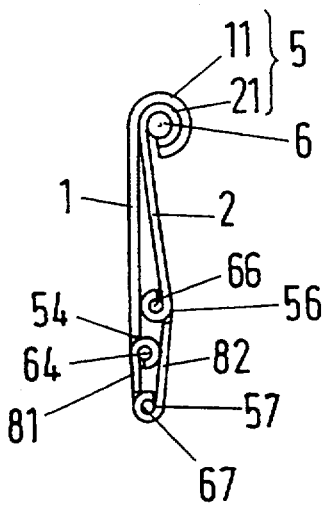
FIGS. 1*a*, 1*b* and 1*c*, a hinge, including a hinge joint configured as knuckles lying one upon the other and a connecting web which is subdivided by a hinge joint.

The hinges for picture frames selected as embodiments are provided with two hinge leaves 1 and 2. Hinge leaf 1 is attached to a picture cover 3 on the rear of the picture frame; hinge leaf 2 is attached to a set-up base 4 of the picture frame - shown only in FIGS. 1*c* and 4*c*. Hinge leaves 1, 2 are configured as knuckles 11, 21 at the abutting edges. Knuckles 11, 21 form hinge knuckles 5. A hinge wire 6 passes through hinge knuckles 5. Hinge knuckles 5 together with the hinge wire 6 form a hinge joint. At a distance from knuckles 11, 21 claws 12, 22 are provided at each hinge leaf. Claws 12 of the one hinge leaf 1 aid in the attachment to the picture cover 3; claws 22 on the other hinge leaf 2 aid in the attachment to the set-up base 4.

On hinge leaf 1 a connecting web 8 is articulated to the edge 13 facing away from the hinge joint. The length of the connecting web 8 is proportional to the opening angle of the hinge. If the hinge is opened the connecting web 8 is arranged at an angle to hinge leaf 1 and is supported by the other hinge leaf 2. If the hinge is closed the connecting web 8 is pivoted into a position essentially parallel to the first hinge leaf 1.

Figure 1C:
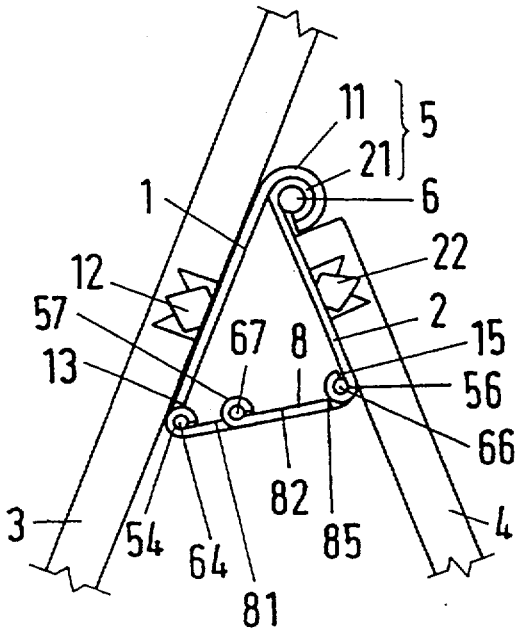
Figure 1A:
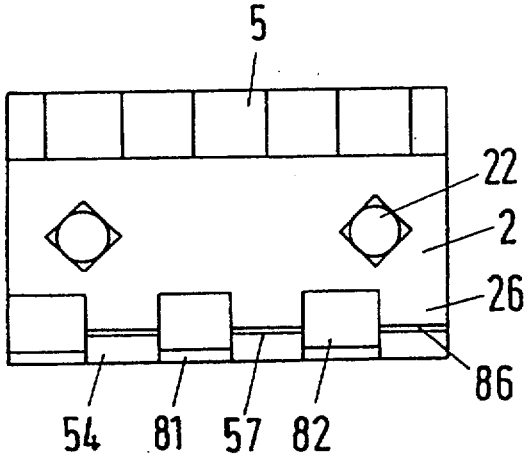

On the hinge shown in FIG. 1, knuckles 11 of the one hinge leaf 1 overlap knuckles 21 of the other hinge leaf 2 in order to form hinge joint 5, 6. In the hinges shown in FIGS. 2 to 4, knuckles 11 of the one hinge leaf 1 mesh in a comb-like fashion with the knuckles 21 of the other hinge leaf 2 in order to form hinge joint 5, 6.

Figure 2B:
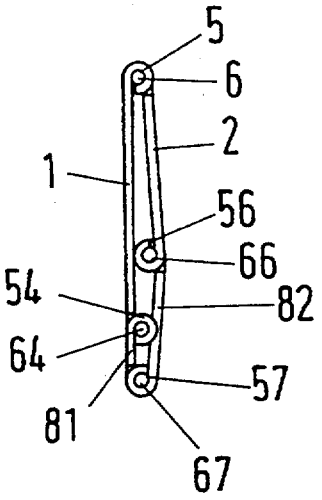
FIGS. 2*a*, 2*b* and 2*c*, a hinge, including a hinge joint configured as juxtaposed knuckles and a connecting web such as the one on the hinge shown in FIG. 1.
Figure 2A:
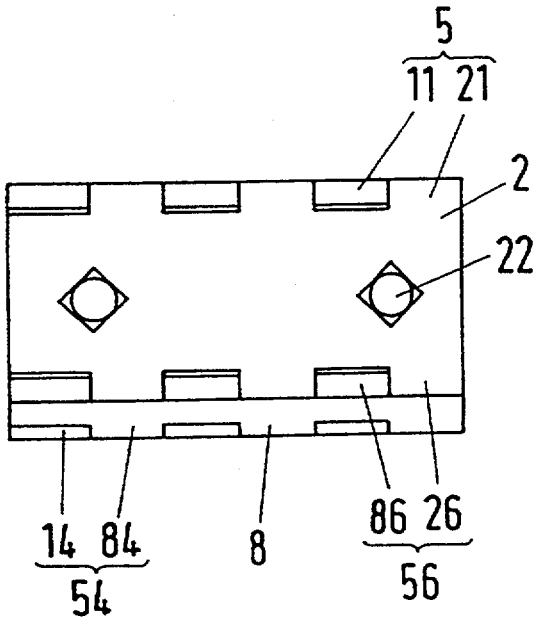
Figure 2C:
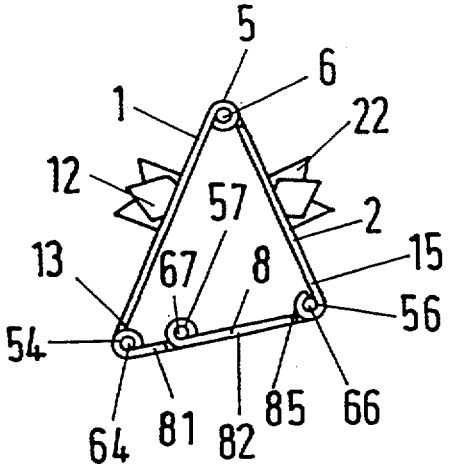

On the hinges shown in FIGS. 1, 2 and 5 the one hinge leaf 1 and the connecting web 8 are configured as knuckles 14, 84 on their abutting edges 13, 83. Knuckles 14, 84 form hinge knuckles 54. A hinge wire 64 passes through the hinge knuckles 54. The hinge knuckles 54 together with the hinge wire 64 form a hinge base joint.

Figure 4A:
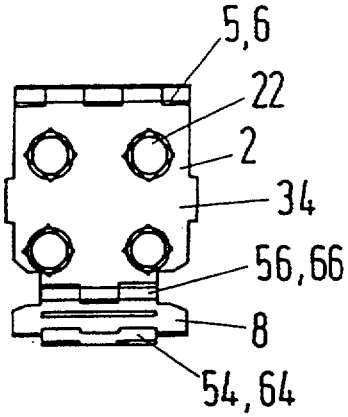
FIGS. 4*a*, 4*b* and 4*c*, a hinge in the attached state.
Figure 4B:
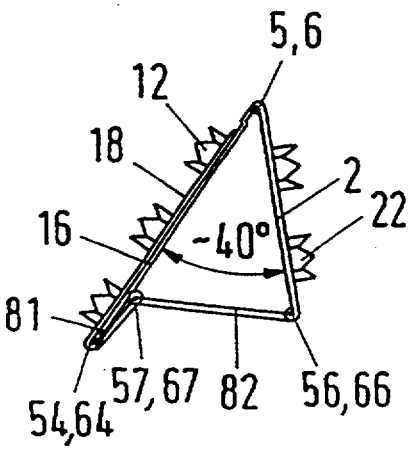
Figure 4C:
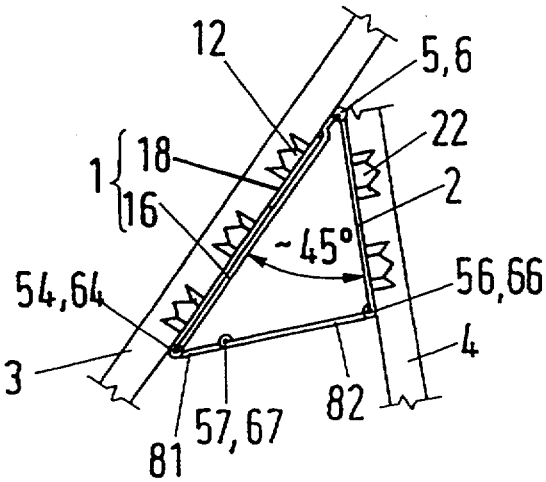
Figure 5A:
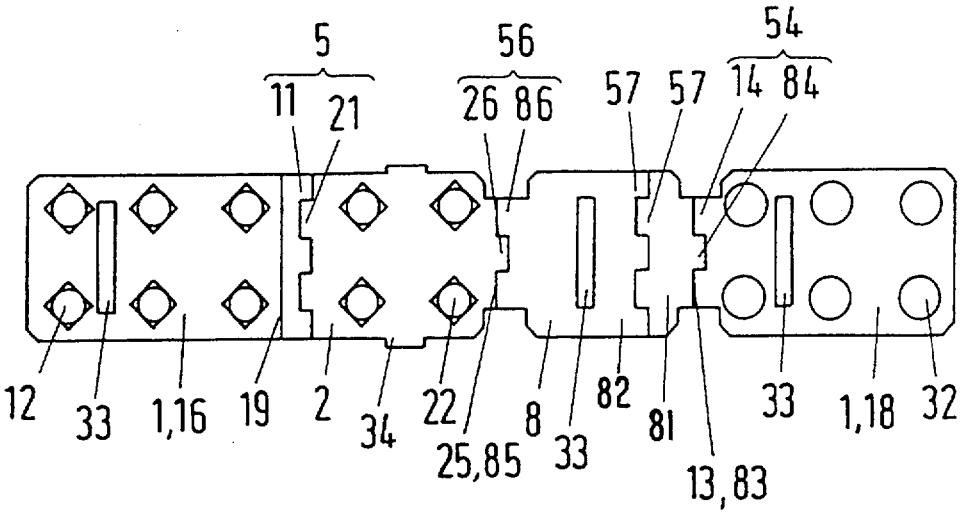
FIGS. 5*a*, 5*b* and 5*c*, the hinge shown in FIG. 4 in folding stages.
Figure 5B:
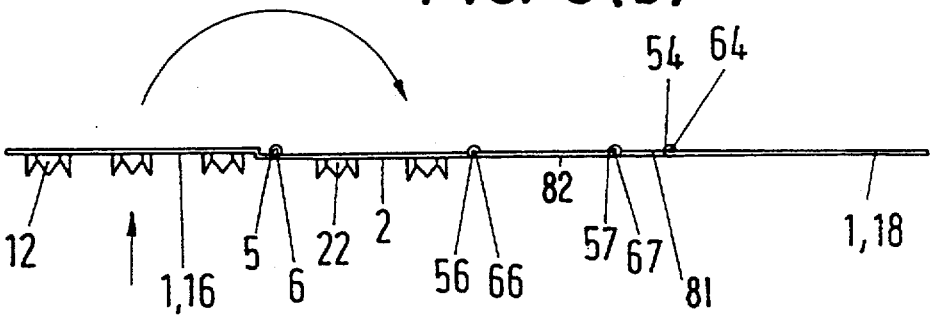
Figure 5C:
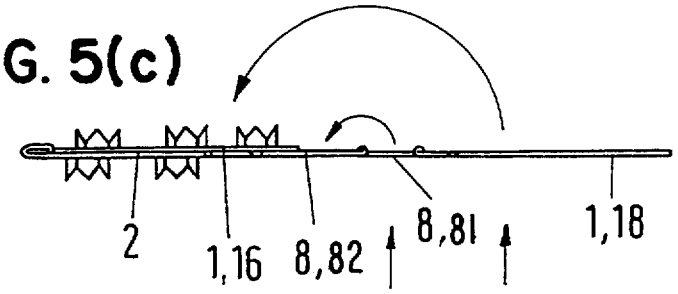
Figure 5D:
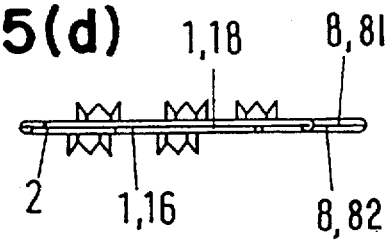

On the hinges shown in FIGS. 1, 4 and 5 the other hinge leaf 2 and the connecting web 8 are also configured as knuckles 26, 86 at their abutting edges 25, 85. Knuckles 26, 86 form hinge knuckles 56. A hinge wire 66 passes through hinge knuckles 56. Hinge knuckles 56, together with hinge wire 66, form an additional hinge base joint.

Connecting web 8 is divided by a web hinge into two mutually pivotable web members 81, 82. In the hinges shown in FIGS. 1, 2, 4 and 5 the web hinge is configured as follows: at their abutting edges web members 81, 82 are configured as knuckles which engage one another in a comb-like fashion.

The knuckles form hinge knuckles 57. A hinge wire 67 passes through the hinge knuckles 57. Hinge knuckles 57 and hinge wire 67 form the web hinge. In the hinge shown in FIG. 3, the web hinge is a film hinge 50.

Figure 3B:
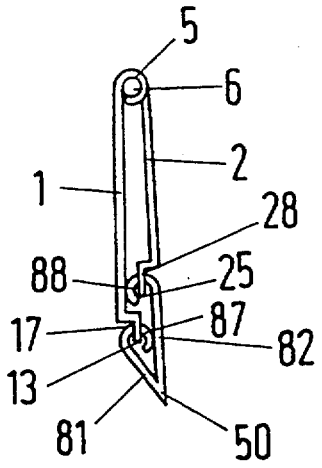
FIGS. 3*a*, 3*b* and 3*c*, a hinge, including a connecting web which is provided with a film hinge.
Figure 3A:
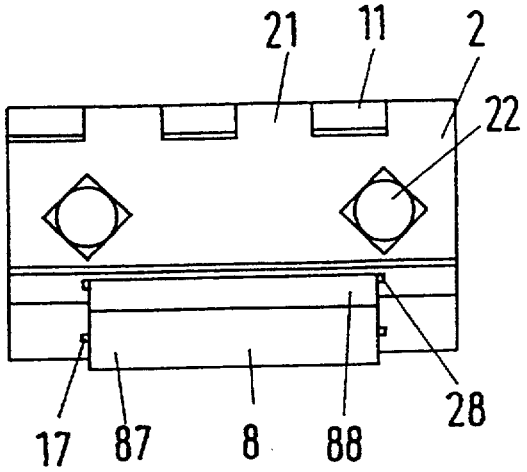
Figure 3C:
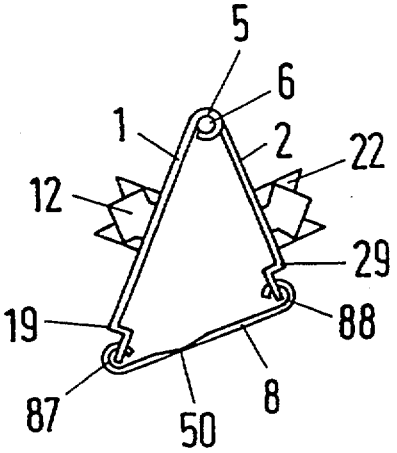

In the hinge shown in FIG. 3, the one hinge Leaf 1 is provided, parallel to its end 13, with a slot 17 into which engages a knuckle 87 molded to connecting web 8. The other hinge leaf 2 is also provided, parallel to its end 25, with a slot 28 into which engages a knuckle 88 molded to connecting web 8. Each hinge leaf 1, 2 is additionally provided with a shoulder 19, 29 at a distance from its end 13, 25 in the direction of the other hinge leaf 2, 1.

Hinge leaf 1 shown on the hinges of FIGS. 4 and 5 is configured as two superimposed leaf members 16, 18. Leaf member 16 is connected with the other hinge leaf 2 by way of hinge joint 5, 6 and is provided with claws 12. The other leaf member 18 is connected with the connecting web 8 by means of base joint 54, 64. This leaf member 18 is provided with openings 32. The openings 32 are arranged in leaf member 18 congruent with the claws 12 in leaf member 16. In the completely collapsed state of the hinge the claws 12 consequently pass through the openings 32. Leaf member 16, which is provided with claws 12 is provided with a shoulder 19 in the direction of the other hinge leaf 2. The dimension of the shoulder 19 is adapted to the thickness of the leaf member 18. If leaf members 16, 18 are placed upon one another, it appears as if hinge leaf 1 between hinge joint 5, 6 and hinge base joint 54, 64 were essentially one piece.

Leaf members 16, 18 as well as web portion 82 are each provided with a transverse slot 33. Hinge joint 5, 6 and web hinge 57, 67 extend over the entire width of hinge leaf 1, 2 of the connecting web 8. In contrast, hinge base joints 54, 64, and 56, 66 are configured narrower than the associated members to which they are molded. The free edges of leaf members 16, 18 of hinge leaf 2 as well as of connecting web 8 are chamfered. Hinge leaf 2 is provided with projections 34 at its longitudinal sides at diametrally opposite locations.

The thickness of the hinge is reduced compared with conventional hinge thicknesses. To configure hinge joint 5, 6, hinge base joints 54, 64 and 56, 66 and web hinge 57, 67, hinge wires 6, 64, 66, and 67 are provided at a reduced diameter.

The hinges shown in FIGS. 1 to 3 pivot from their closed position - shown in each case as illustration (b) - in which web hinges 57, 67 form the lowest limit of the hinge, into the open position - in each case, illustration (c) - with web member 81 being pivoted about the one hinge leaf 1, both web members 81, 82 being pivoted about one another and web member 82 being pivoted about the other hinge leaf until web members 81, 82 lie in the same plane.

In the hinges shown in FIGS. 4 and 5, with set-up base 4 contacting the picture cover 3, web hinge 57, 67 lies in a plane, defined by hinge joint 5, 6 and base joint 54, 64, i.e., on the side and facing away from hinge joint 5, 6. If the set-up base 4 is unfolded, web hinge 57, 67 is able to assume two fixed positions: in the plane mentioned, web hinge 57, 67 may be pivoted to the side and facing hinge joint 5, 6 - see FIG. 4(*d*). But web hinge 57, 67 may also be pivoted into the plane defined by base joints 54, 64 and 56, 66 - see FIG. 4(*c*). Thus, the possibility exists, in principle, for selecting the pivot angle of the hinge. Moreover, by way of the position of the web hinge 57, 67 between web members 81, 82, i.e., by way of the selection of the length of these web members, a second set-up angle can be fixed.

Attaching the hinges to the picture cover 4, on the one hand, and to the set-up base 4, on the other hand, starts with a hinge whose members are folded in one plane - see FIGS. 5(*a*) and (*b*). Initially, leaf member 16 is pivoted 180° about hinge joint 5, 6 until it contacts hinge leaf 2 - transition from FIG. 5(*b*) to (*c*). Then hinge leaf 2 and web member 81 are pivoted about the web hinge 57, 67 - by 180° - transition from FIG. 5(*c*) to (*d*). During this pivoting movement, claws 12 on leaf member 16 pass through openings 32 in leaf member 18. All hinge members, i.e., leaf members 16 and 18, hinge leaf 2, and web members 81, 82 lie adjacent to one another in one plane - see FIGS. 4(*a*) and 5(*d*). In this position it is easy to attach the hinge to the picture cover 3 and to the set-up base 4.

Hinge leaves 1, 2 and/or the knuckles 11, 12 can be connected at their end faces with hinge leaves and knuckles of other hinges to form a strip-like workpiece. The workpiece is then conveyed to an attaching machine where the hinges are separated and fastened to the picture cover 3 and the set-up base 4.

Commercial Utility:

The hinge is used for picture frames including a set-up base.

I claim:

1. A hinge for use with a picture frame and a set-up base, comprising:

first and second hinge leaves, each hinge leaf having claws, the claws of the first hinge leaf for fastening the first hinge leaf to a picture frame and the claws of the second hinge leaf for fastening the second hinge leaf to a set-up base;

a hinge joint disposed at first ends of the hinge leaves, configured of knuckles through which a hinge wire passes, for connecting the first and second hinge leaves to one another; and a connecting web movably articulated to the first hinge leaf at an end edge of the first hinge leaf opposite the hinge joint, and pivotably connected and supported at an end of the second hinge leaf at an edge of the second hinge leaf opposite the hinge joint to limit an opening angle of the hinge, wherein the connecting web is divided by a web hinge into first and second mutually pivotable web members;

wherein when the hinge is in an opened position, the first one of the web members of the connecting web is pivoted and arranged at an angle or parallel to the first hinge leaf while the second one of the web members is pivoted and supported by the second hinge leaf;

wherein when the hinge is in a closed position, the connecting web is pivoted into a position essentially parallel to the first and second hinge leaves, whereby the hinge ensures a stable limitation of an opening angle of the hinge leaves with respect to one another and thereby ensures a stable limitation of an opening angle of the set-up base with respect to a picture frame; and wherein the web hinge is a film hinge.

2. A hinge according to claim 1, wherein the first hinge leaf and the connecting web are connected to one another by means of a hinge base joint configured as knuckles through which a hinge wire passes.

3. A hinge according to claim 1, wherein the first hinge leaf is provided, parallel to the end edge opposite the hinge joint, with a slot into which engages a knuckle molded to the connecting web.

4. A hinge according to claim 1, wherein the connecting web and the second hinge leaf are connected to one another by way of a hinge base joint configured as knuckles penetrated by a hinge wire, first ones of said knuckles being provided at an edge of the second hinge leaf and second ones of said knuckles being provided opposite the hinge joint at an end of the connecting web.

5. A hinge according to claim 1, wherein, parallel to an end edge of the second hinge leaf, the second hinge leaf is provided with a slot into which engages a knuckle that is molded to the connecting web.

6. A hinge according to claim 1, wherein the first hinge leaf is provided with a shoulder at a distance from an end edge thereof opposite the hinge joint, the shoulder extending in the direction of the second hinge leaf.

7. A hinge according to claim 1, wherein the web hinge is configured as knuckles, the knuckles being molded to adjacent ends of the web members, assembled into a hinge knuckle, and penetrated by a hinge wire.

8. A hinge for use with a picture frame and a set-up base, comprising:

first and second hinge leaves, each hinge leaf having claws, the claws of the first hinge leaf for fastening the first hinge leaf to a picture frame and the claws of the second hinge leaf for fastening the second hinge leaf to a set-up base;

a hinge joint disposed at first ends of the hinge leaves, configured of knuckles through which a hinge wire passes, for connecting the first and second hinge leaves to one another; and a connecting web movably articulated to the first hinge leaf at an end edge of the first hinge leaf opposite the hinge joint, and pivotably connected and supported at an end of the second hinge leaf at an edge of the second hinge leaf opposite the hinge joint to limit an opening angle of the hinge, wherein the connecting web is divided by a web hinge into first and second mutually pivotable web members;

wherein when the hinge is in an opened position, the first one of the web members of the connecting web is pivoted and arranged at an angle or parallel to the first hinge leaf while the second one of the web members is pivoted and supported by the second hinge leaf;

wherein when the hinge is in a closed position, the connecting web is pivoted into a position essentially parallel to the first and second hinge leaves, whereby the hinge ensures a stable limitation of an opening angle of the hinge leaves with respect to one another and thereby ensures a stable limitation of an opening angle of the set-up base with respect to a picture frame;

wherein the first hinge leaf is configured as two superimposed leaf members;

wherein a first one of the two superimposed leaf members is provided with the claws and connected with the second hinge leaf by way of the hinge joint; and wherein a second one of the two superimposed leaf members is connected with the connecting web and is provided with openings for passage of the claws.

9. A hinge according to claim 8, wherein the first leaf member which is provided with the claws has a shoulder at a distance from the hinge joint in the direction of the second hinge leaf.

10. A hinge according to claim 8, wherein the first hinge leaf and the connecting web are connected to one another by means of a hinge base joint configured as knuckles through which a hinge wire passes, wherein the connecting web is divided by a web hinge into two mutually pivotable web members, and wherein the hinge joint, the hinge base joints and the web hinge are configured as knuckles that are molded to respective abutting members, are fitted into each other in a comb-like fashion to form respective hinge knuckles, and are each penetrated by a hinge wire.

11. A hinge according to claim 10, wherein for the formation of the hinge joint, the hinge base joints and the web hinge, hinge wires with a reduced diameter are used.

12. A hinge according to claim 10, wherein the web hinge can be pivoted from a position in a plane defined by the hinge joint and one of the base joints and into a position in a plane defined by the base joints.

13. A hinge for use with a picture frame and a set-up base, comprising:

first and second hinge leaves, each hinge leaf having claws, the claws of the first hinge leaf for fastening the first hinge leaf to a picture frame and the claws of the second hinge leaf for fastening the second hinge leaf to a set-up base;

a hinge joint disposed at first ends of the hinge leaves, configured of knuckles through which a hinge wire passes, for connecting the first and second hinge leaves to one another; and a connecting web movably articulated to the first hinge leaf at an end edge of the first hinge leaf opposite the hinge joint, and pivotably connected and supported at an end of the second hinge leaf at an edge of the second hinge leaf opposite the hinge joint to limit an opening angle of the hinge wherein the connecting web is divided by a web hinge into first and second mutually pivotable web members;

wherein when the hinge is in an opened position, the first one of the web members of the connecting web is pivoted and arranged at an angle or parallel to the first hinge leaf while the second one of the web members is pivoted and supported by second hinge leaf;

wherein when the hinge is in a closed position, the connecting web is pivoted into a position essentially parallel to the first and second hinge leaves, whereby the hinge ensures a stable limitation of an opening angle of the hinge leaves with respect to one another and thereby ensures a stable limitation of an opening angle of the set-up base with respect to a picture frame; and wherein the hinge leaves and/or the knuckles thereof are joined together with hinge leaves and/or knuckles of other hinges into a strip-like workpiece.

* * * * *

UNITED STATES PATENT AND TRADEMARK OFFICE

CERTIFICATE OF CORRECTION

PATENT NO. : 5,371,924

DATED : December 13, 1994

INVENTOR(S) : Karl E. Schmale

It is certified that error appears in the above-indentified patent and that said Letters Patent is hereby corrected as shown below:

On the title page, item [30] insert --January 10, 1991 [PCT] .....PCT/DE91/00014--.

Signed and Sealed this

Twenty-eight Day of February, 1995

*Attest:*

*Attesting Officer*

BRUCE LEHMAN

*Commissioner of Patents and Trademarks*